United States Patent [19]

Weichman

[11] 4,285,547

[45] Aug. 25, 1981

[54] INTEGRATED IN SITU SHALE OIL AND MINERAL RECOVERY PROCESS

[75] Inventor: Bernard E. Weichman, Houston, Tex.

[73] Assignee: Multi Mineral Corporation, Houston, Tex.

[21] Appl. No.: 117,570

[22] Filed: Feb. 1, 1980

[51] Int. Cl.[3] ..... E21C 43/00

[52] U.S. Cl. ..... 299/2; 166/259

[58] Field of Search ..... 299/2; 166/259

[56] References Cited

U.S. PATENT DOCUMENTS

| | | | |
|---|---|---|---|
| 2,481,051 | 9/1949 | Uren | 299/2 |
| 3,001,776 | 9/1961 | Van Poollen | 299/2 |
| 3,316,020 | 4/1967 | Bergstrom | 299/2 |
| 3,586,377 | 6/1971 | Ellington | 299/4 |
| 3,821,353 | 6/1974 | Weichman | 423/119 |
| 3,994,343 | 11/1976 | Cha et al. | 166/259 |
| 4,005,752 | 2/1977 | Cha | 299/2 |
| 4,043,598 | 8/1977 | French et al. | 299/2 |
| 4,082,645 | 4/1978 | Knight et al. | 208/11 R |
| 4,105,072 | 8/1978 | Cha | 299/2 |
| 4,140,181 | 2/1979 | Ridley et al. | 299/2 |

*Primary Examiner*—Ernest R. Purser
*Attorney, Agent, or Firm*—Arnold, White & Durkee

[57] ABSTRACT

A method for the in situ processing of mineral-bearing oil shale ore includes the establishment of a plurality of underground stopes by removing from each a portion of the oil shale ore therein, rubblizing the remaining ore in each stope, extracting the rubblized ore and crushing it to obtain a nahcolite fraction and an oil shale fraction having a desired particle size for subsequent processing, and restoring sized oil shale particles to the stope by back filling the stope as the rubble is extracted so as to maintain the stope substantially filled with particles to provide lateral support to the side walls and reduce the likelihood of caving in the stope. The nahcolite fraction is recovered from the crushed ore prior to backfilling of the stopes for retorting to recover shale oil, while soda ash and alumina may be recovered from the spent shale by leaching the stopes after retorting. A method of retorting is also disclosed in which three retorts are operated in series, the first retort comprising a gas heating retort, the second a carbon recovery retort and the third an active retort.

11 Claims, 12 Drawing Figures

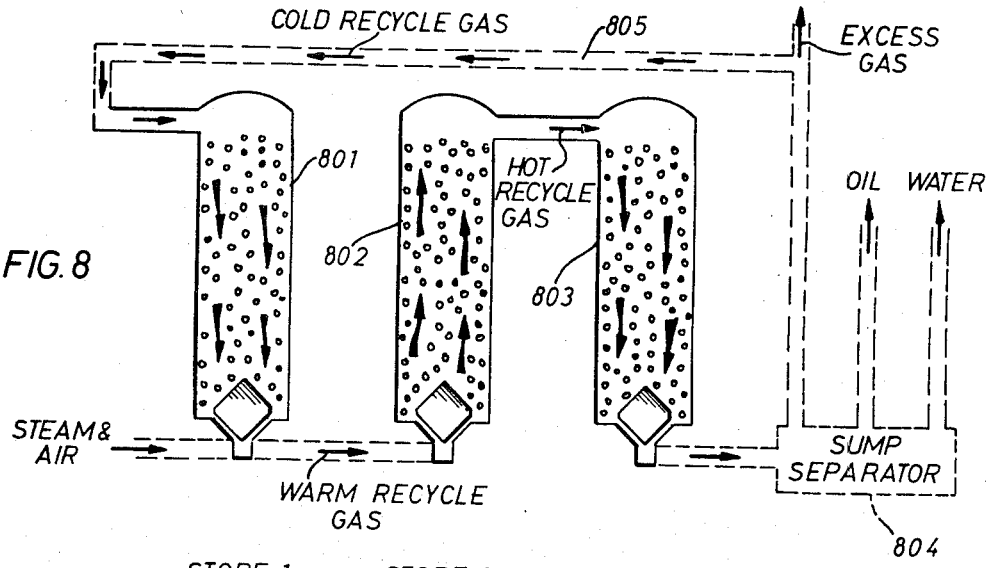
FIG. 8
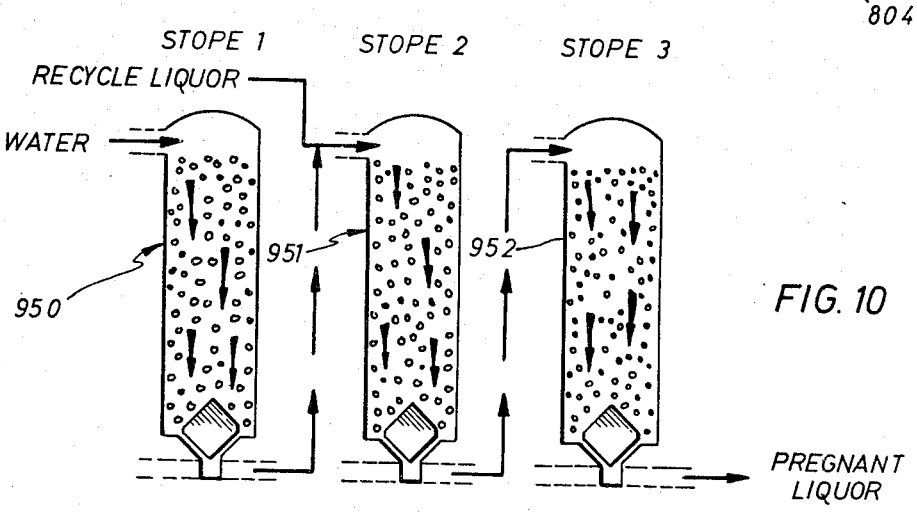
FIG. 10
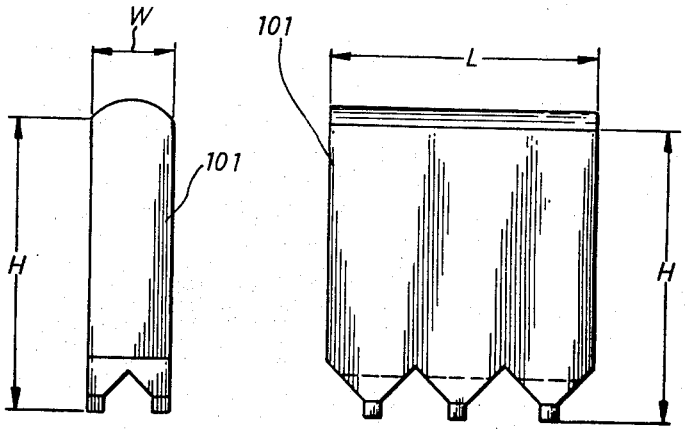
FIG. 2a
FIG. 2b
FIG. 2

FIG. 5
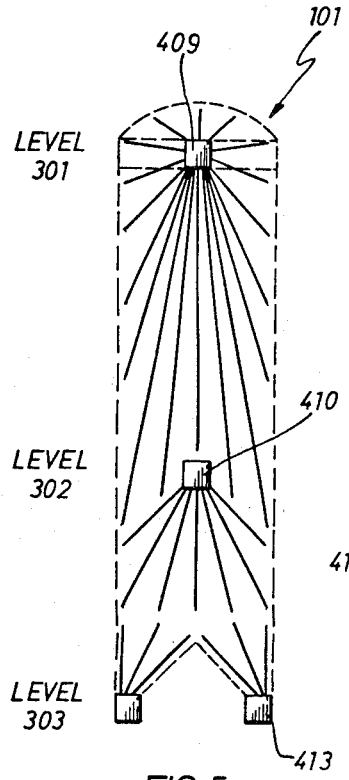
FIG. 5a
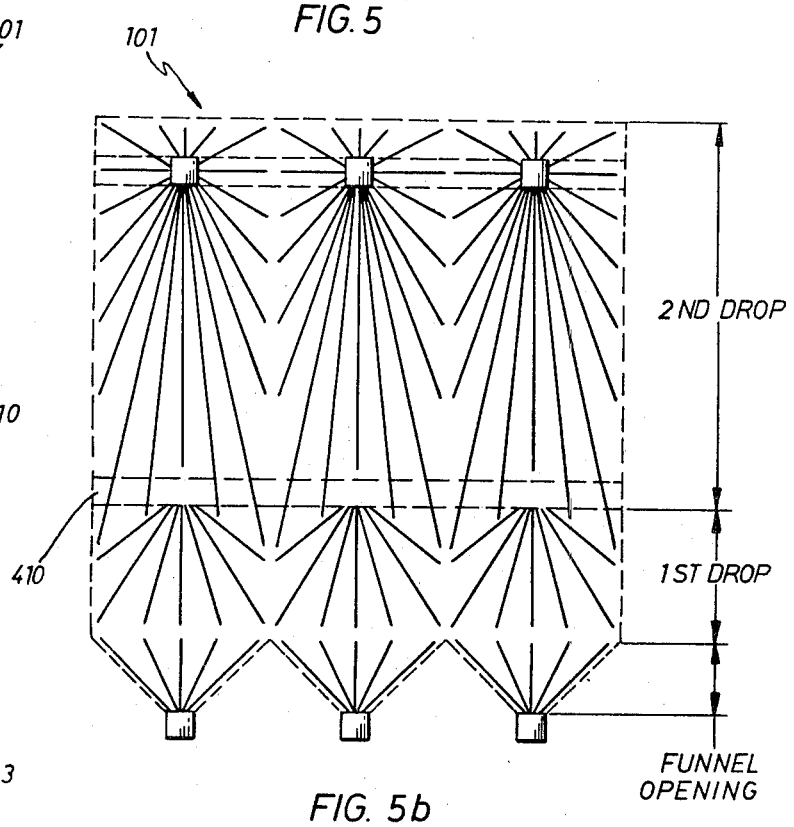
FIG. 5b
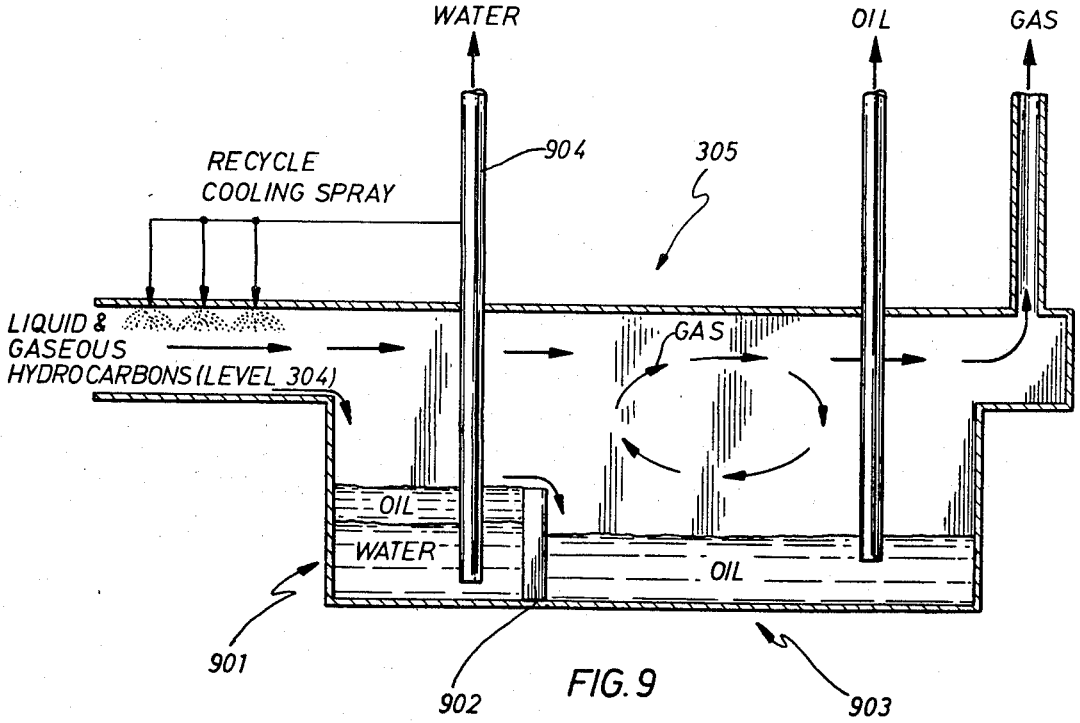
FIG. 9

INTEGRATED IN SITU SHALE OIL AND MINERAL RECOVERY PROCESS

BACKGROUND OF THE INVENTION

1. Field of the Invention

The present invention relates to the production of hydrocarbon products and minerals from oil shale deposits, and, more particularly, to the in situ processing of oil shale ore to recover said hydrocarbon and mineral products.

2. Description of the Prior Art

The presence of large deposits of oil shale in the Rocky Mountain region of the United States has given rise to extensive efforts to develop methods for the recovery of hydrocarbon and mineral products therefrom. The term "oil shale" is widely used to refer to a layered sedimentary formation containing an organic waxy material known as kerogen. While kerogen is practically immobile within the oil shale, when the oil shale is heated over a period of time and to an appropriate temperature, the kerogen decomposes to produce gaseous and liquid hydrocarbon products. Additionally, it has been found that some oil shale deposits contain substantial quantities of other valuable minerals, such as nahcolite, a naturally occurring sodium bicarbonate, and dawsonite, a sodium-aluminum compound, recovery of which will help to make recovery of the hydrocarbon products more economically feasible. The term "oil shale ore" is used herein to include such mineral-bearing shales.

Deposits of oil shale ore have not been exploited to a significant extent as a source of oil due to the relatively high cost of mining and recovering the oil, and the environmental considerations involved in such operations. However, there have been four basic methods proposed for processing the oil shale ore, namely: the pure in situ method; the modified in situ method; the surface retort method; and the multi-mineral method. At the present time, it is believed that the pure in situ method is still experimental in nature.

On the other hand, the modified in situ method is very popular with the industry, because it represents an attractive concept for low-cost production of shale oil by underground pyrolysis. With the modified in situ method, an underground retort is formed by removing a portion, e.g., 15 to 30 percent, of the oil shale ore in the retort zone to create a void space. This ore, which is mined by conventional techniques, is transported to the surface. Explosives are then disposed in the ore deposit and the underground retort zone is created by detonating the explosives to rubblize the remaining oil shale ore, which then fills the retort zone. The rubblized oil shale ore is then subjected to pyrolysis by igniting the ore and sustaining the burn by pumping air into one end of the chamber and withdrawing gases from the other. As the burn front advances through the retort zone, the hot combustion gases pyrolize the kerogen in the oil shale to form hydrocarbon vapors. These vapors are cooled as they move toward the base of the chamber, where they contact the cooler ore and condense into shale oil. The oil may then be pumped from the base of the retort and piped to the surface.

The modified in situ method has two shortcomings: channeling and water entry. The phenomenon of channeling occurs due to the presence of fine particles, i.e., the "fines", in the oil shale rubble. The permeability of the portions of the rubblized bed of ore containing the "fines" is lower than the permeability of the portions of the bed containing the larger particles of oil shale ore. The burn front advances more rapidly where the bed has a higher permeability, and the areas of the retort zone comprising "fines" are bypassed and not retorted. Accordingly, substantial quantities of shale oil might not be recovered, thereby resulting in an inefficient and less economical process.

As noted above, a second problem with the modified in situ method arises by virtue of water entry into the retort zone. Water entry is commonly encountered because joints and fractures are abundant in many of the oil shale ore deposits. If a particular area is water-bearing, the detonation of explosives may permit water to flow into the retort. The water is costly to remove, and causes inefficient retorting when it contacts the burn front.

There are several methods of surface retorting, e.g., as disclosed in U.S. Pat. No. 3,025,223 to Aspergren, et al. While surface retorting techniques have been utilized, they are not only labor and material intensive, but also present environmental difficulties which may be costly to overcome. The economics of surface retorts have not yet been proven in commercial scale, and they are highly capital intensive.

With the multi-mineral oil shale process, nahcolite, shale oil, alumina, and soda ash may be obtained from the mineral-bearing oil shale ore. The multi-mineral process is a surface technique and may employ a circular grate as the pyrolysis mechanism. For a more detailed explanation of this process, reference should be made to U.S. Pat. Nos. 3,821,353 to Weichman and 4,082,645 to Knight, et al. While the multi-mineral process has many desirable characteristics, the surface nature of the operation makes it labor intensive and subject to the environmental considerations mentioned above.

SUMMARY OF THE INVENTION

In accordance with the present invention, a method is provided for the in situ processing of mineral-bearing oil shale ore to recover shale oil, nahcolite, alumina, and soda ash.

According to the present invention, a plurality of underground chambers ("stopes") are established. Each stope is formed by rubblizing the oil shale ore therein, extracting the rubblized oil shale ore from the chamber, separating at least a portion of the nahcolite from the extracted ore, and restoring the remaining oil shale to the chamber for retorting. In accordance with one feature of the present invention, each chamber is backfilled with oil shale particles of predetermined size while the extraction and separating steps are performed, so that the chamber always contains a substantial amount of material to provide lateral support to the chamber walls to reduce the likelihood of caving.

In accordance with the present invention, the oil shale in the first stope has been subjected to retorting and carbon recovery, while the oil shale in the second stope has been subjected to in situ retorting. The oil shale in the third stope has been rubblized in preparation for retorting.

Cool gas is injected into the top of the first stope and passed through the first stope to recover sensible heat from the shale and heat the injected gas. The heated gas emerges from the base of the first stope and is then used to effect carbon recovery from the retorted ore in the second stope. The heated gas is mixed with steam and a controlled amount of air or other source of oxygen and injected into the second stope under controlled conditions to recover the heating value of the residual carbon on the retorted shale. Under properly controlled conditions this will generate a producer fuel gas in an exothermic reaction which heats the gas to a retorting temperature.

The hot gas exiting from the second stope is then fed down through the third stope to retort the rubblized oil shale particles therein. The retorting produces gaseous and liquid hydrocarbon products which are collected in a sump/separator. The gas phase leaving the third stope is cooled to recover condensable hydrocarbons. A portion of the noncondensable gas fraction is recycled to the top of the first stope, and the remainder is conveyed to the surface for use. The liquid phase comprises water and oil, which are separated.

While the third stope is being retorted, a fourth stope is prepared for retorting. When the retorting of the third stope is complete, the process is repeated with the second stope being the heating stope, the third stope being the carbon recovery stope, and the fourth stope being the retort stope.

The spent shale in the first stope may be leached to recover alumina and soda ash. Preferably, leaching is accomplished by injecting water and caustic into the top of the stope, and, as the liquid percolates down through the bed of spent shale particles in the stope, it dissolves the soda and alumina in the spent shale. The liquid is collected at the base of the stope and pumped to the surface for recovery of soda and alumina.

BRIEF DESCRIPTION OF THE DRAWINGS

In the accompanying drawings:

FIGS. 2*a* and 2*b* are side and front elevation views, respectively, of one of the stopes illustrated in FIG. 1.

FIGS. 5*a* and 5*b* are side and front elevation views, respectively, which illustrate a stope which has been drilled for blasting.

FIG. 8 is a side elevation view of three adjacent stopes, illustrating the flow of gas through the stopes in accordance with another feature of the present invention.

FIG. 9 is a front elevation view of a sump/separator used to collect the products of retorting of a stope.

FIG. 10 is a side elevation view of three adjacent stopes, illustrating the flow of leach liquor through the stopes in accordance with yet another feature of the present invention.

DESCRIPTION OF SPECIFIC EMBODIMENTS

It will be appreciated that the present invention can take many forms and embodiments. Some embodiments of the invention will be described so as to give an understanding of the invention. It is not intended, however, that the illustrative embodiments described herein should in any way limit the true scope and spirit of the invention.

I. MINING TECHNIQUE AND STOPE PREPARATION

Figure 1:
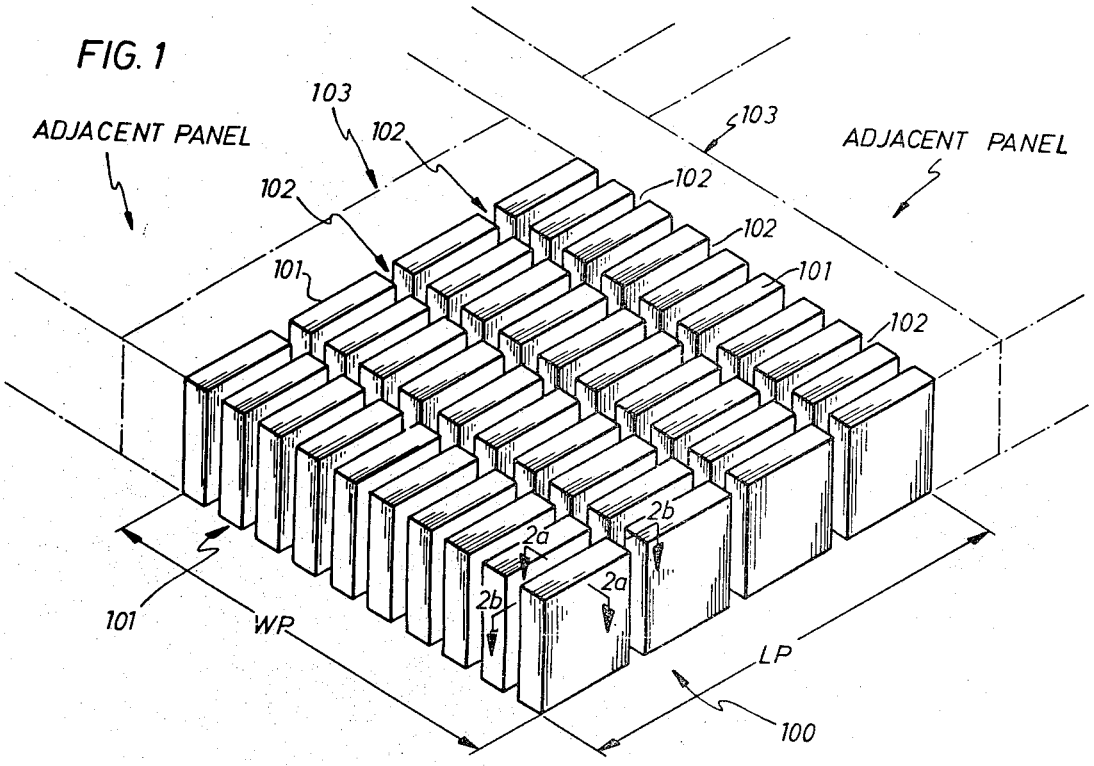
FIG. 1 is a perspective view of a subterranean mining panel, which diagrammatically illustrates stope formation in the panel.

Referring now to FIG. 1, a mining concept which may be used in carrying out the present invention comprises dividing a mine zone into areas called panels. FIG. 1 illustrates one such panel 100. Each panel is enclosed by a solid barrier wall 103 of unbroken oil shale, and, in the illustrated embodiment, the length, $L_p$, and width, $W_p$, of panel 100 are each approximately 2640 feet. Within panel 100, mining is done by creating a plurality of chambers or stopes 101, and, preferably, each panel contains 40 such stopes. Each stope 101 is separated from adjacent stopes by relatively thick, e.g., 100 ft., unbroken pillars 102. It will be appreciated that the various dimensions of the panels and stopes will be modified to suit the character of the ore deposit and the structure of the adjacent rock, and that the foregoing dimensions and those which follow exemplify only one embodiment of the present invention.

Referring now to FIG. 2, there are illustrated two cross-sectional views of one of the stopes 101 of FIG. 1. FIG. 2*a* illustrates a side elevation view of stope 101, which has a height H and a width W. In the illustrated embodiment, height H is approximately 600 feet, while width W is approximately 164 feet. As shown in FIG. 2*b*, stope 101 additionally has length L, which is approximately 560 feet.

Figure 3:
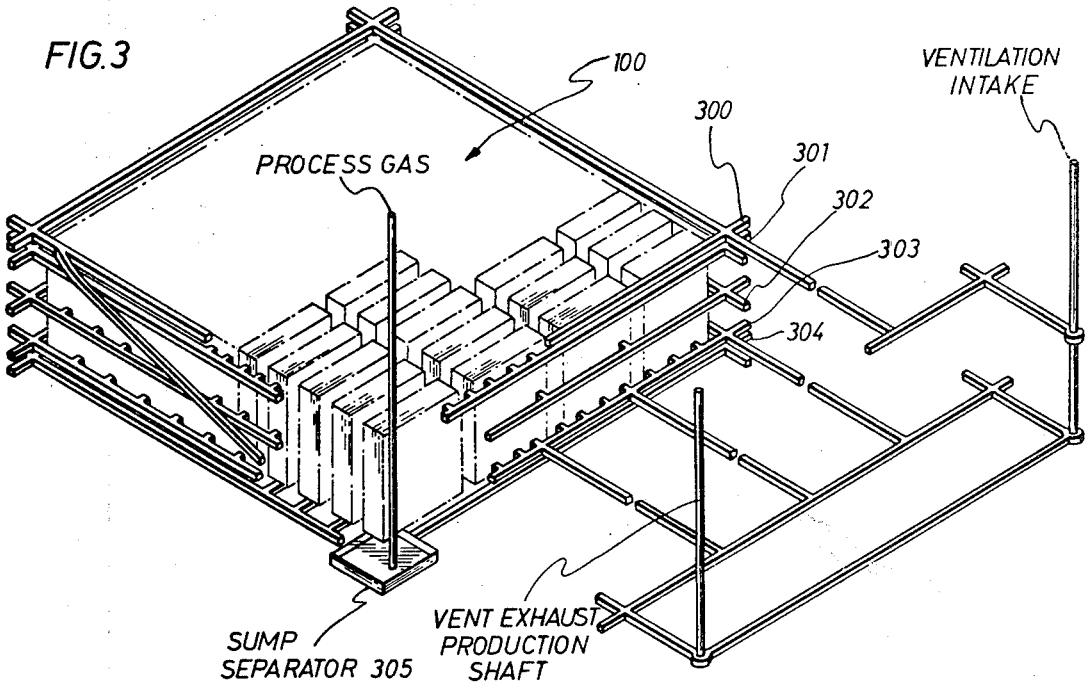
FIG. 3 is a perspective view of the subterranean panel of FIG. 1, which illustrates the mining levels employed within a panel.

Referring now to FIG. 3, there is illustrated a schematic diagram of the various mining levels 300–304 which are formed in panel 100 to permit access to the stopes therein. For each level 300–304, these accesses are formed both in the barrier pillars between mining panels and in the rib pillars between stopes within a mining panel. For simplicity of illustration, the mining accesses 300–304 in FIG. 3 are only shown in the barrier pillars.

Still referring to FIG. 3, the lowermost level 304 is used as the liquid and gas passageway during processing operations, as hereinafter described, and level 304 preferably has dimensions of 30 feet by 30 feet. On the other hand, level 300 is used for personnel ingress and egress, and serves as the primary means of ventilation intake. Level 300 also preferably has dimensions of 30 feet by 30 feet.

Figure 4:
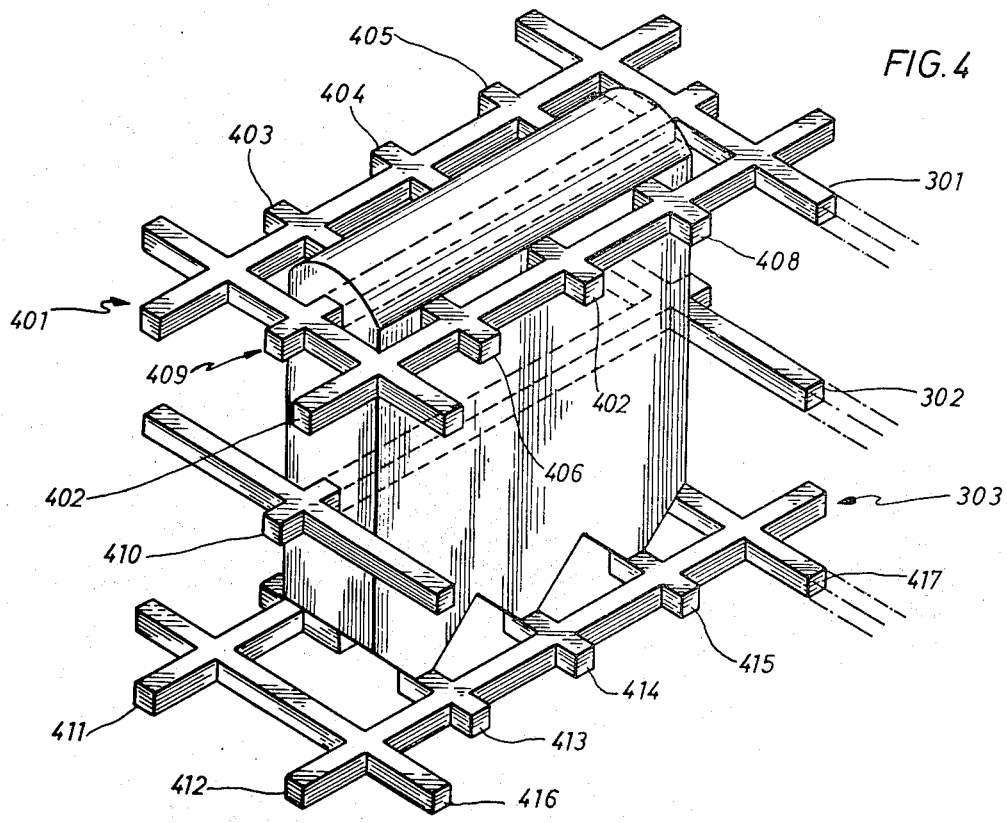
FIG. 4 is a perspective view of a stope, which illustrates drifts and accesses which are formed in the stope at various mining levels.

Now referring to FIG. 4, there is illustrated in detail the drifts and accesses which are formed at each level 301–303 for each stope 101. At level 301, two drifts 401 and 402 are formed in the center of each rib pillar along the length L of stope 101. From drift 401, three cross-cuts 403–405 are formed, permitting access to the top of stope 101. Likewise, from drift 402, three cross-cuts 406–408 are formed in the other side of the stope 101. Drifts 403–408 are used primarily for backfilling the stope with oil shale particles and in subsequent processing of the oil shale, as hereinafter described. Drifts 401 and 402 preferably have dimensions of 30 feet by 30 feet.

Drift 409 is also formed at level 301 in the center of each stope 101 along its length L. At level 302, drift 410 is formed in the center of stope 101 along its length L. Drifts 409 and 410 preferably have dimensions of 20 feet by 20 feet, and are used for access to the stope for the drilling and loading of blast holes, as hereinafter described.

Still referring to FIG. 4, mining at level 303 is accomplished primarily for oil shale extraction from stope 101 and for exhaust ventilation. Two drifts 411 and 412 are formed in the center of the rib pillars along the full length L of stope 101. Three cross-cuts 413–415 from drift 411 are formed which permit access to the base of stope 101. Likewise, three cross-cuts (not shown) from drift 411 are formed, permitting access to the base of stope 101 on the other side. Lastly, two drifts 416 and 417 are formed in the rib pillars at the ends of stope 101, and permit connection between the various drifts 411 and 412 within the panel.

Referring now to FIG. 5, there is diagrammatically illustrated the manner in which drill holes are formed in stope 101 for the loading of explosives. As shown, blast hole drilling is effected in stope 101, at each level 301–303 through the various drifts and accesses formed at each level. At the base of stope 101, at level 303, the blast holes are drilled to outline a funnel configuration toward the cross-cuts 413–415, as shown. Upon completion of drilling, the blast holes may be loaded with suitable explosives.

After the explosives are loaded, rubblization of the oil shale ore in stope 101 is accomplished by detonating the explosives. Preferably, this detonation occurs sequentially, with the explosives loaded in the drill holes formed at levels 302 and 303 being detonated prior to the detonation of the explosives loaded in the drill holes at level 301. This sequential blasting technique is employed in order to create void or expansion space for the oil shale ore above level 302 following the second detonation.

Figure 6:
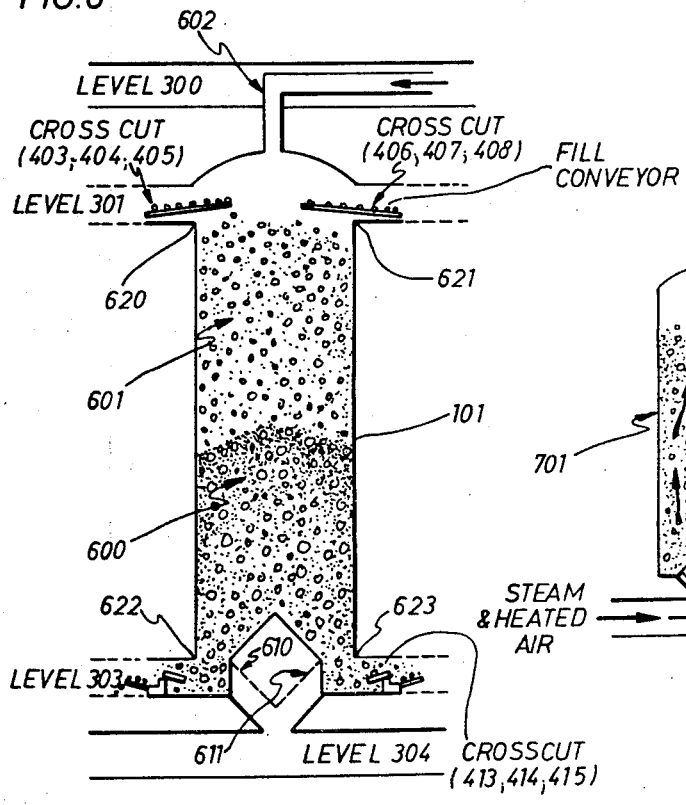
FIG. 6 is a side elevation view of a stope containing some rubblized oil shale ore and partially backfilled with oil shale particles in accordance with one feature of the present invention.

Referring now to FIG. 6, the detonation of the explosives loaded in stope 101 rubblizes the oil shale ore therein. This rubblization produces oil shale ore particles of various sizes, as shown by reference designator 600. The rubblized oil shale ore is extracted from stope 101 at its base (level 304) through the cross-cuts, e.g., 413, formed therein in a manner similar to that employed in conventional caving operations. The extracted oil shale ore is then subjected to impact crushing, which produces a first fraction of particles comprising substantially nahcolite and a second fraction of particles comprising substantially the remaining oil shale ore. Since the nahcolite in the oil shale ore is more brittle than the oil shale, the nahcolite fractures upon impact crushing to yield particles which are smaller in size than the bulk of the remaining oil shale particles. Accordingly, the particles comprising substantially nahcolite may be separated from the particles comprising substantially oil shale on the basis of relative size by appropriate means, e.g., screening. If desired, the oil shale ore may be subjected to several stages of impact crushing prior to screening, or the second fraction of oil shale particles may be subjected to additional crushing following the separation of the nahcolite particles.

Preferably, crushing is carried out until all particles can pass through a 12-inch mesh. Then, those particles whose size is too great to pass through a 4-inch mesh are returned to the stope for retorting. Particles which pass through a 4-inch mesh but not through a ¼-inch mesh are conveyed to the surface for stockpiling. Particles which pass through the ¼-inch mesh (i.e., the "fines") comprise at least 60% nahcolite and are conveyed to the surface to be sold "as is" for air pollution control, e.g., cleaning flue gases and the like.

Still referring to FIG. 6, a significant feature of the present invention comprises the backfilling of a stope 101 with crushed, sized oil shale particles, while the extraction of oil shale ore from the base is in progress. This backfilling is accomplished by conveying the crushed, sized particles comprising substantially oil shale to the six cross-cuts formed at level 301. This backfilling technique provides stability to the stope by laterally supporting the chamber walls to prevent caving during the extraction and crushing processes. In FIG. 6, the backfilled oil shale particles are illustrated with the reference numeral 601.

Referring still the FIG. 6, when all the rubblized oil shale ore in stope 101 has been extracted and the stope has been filled with sized oil shale particles, each cross-cut access on level 303 is sealed in preparation for retorting the oil shale particles in stope 101. Likewise, each cross-cut access on level 301 is sealed prior to retorting. Sealing may be accomplished using conventional grouting techniques.

Prior to the commencement of retorting, diagonal accesses, e.g., 610 and 611, are drilled from level 304 to each cross-cut at level 303 of stope 101. These diagonal accesses provide conduits for the flow of the products of retorting from the base of stope 101 to level 304.

II. IN SITU OIL SHALE PROCESSING

The following describes the processing technique of the present invention with reference to stopes mined and prepared in accordance with the above described mining technique. However, it should be appreciated that the processing techniques may be employed with stopes mined and prepared in accordance with any suitable mining technique.

Still referring to FIG. 6, retorting of the first stope 101 is accomplished by injecting hot gas into the top of the stope. Injection may be accomplished by drilling one or more accesses from level 300 to the top of the stope 101. Suitable piping 602 may then be installed in each access as a conduit for the hot gas. During retorting, kerogen in the oil shale particles is vaporized and a portion of this vapor condenses into a liquid product at the base of stope 101. The liquid product is channelled to level 304 via the diagonal accesses, e.g., 610 and 611, for collection at a suitable point in the mine panel.

While the first stope is being retorted, an adjacent stope in the panel is prepared for retorting in the manner described above for the first stope. When the retorting of the first stope is complete, the first stope is then in a condition to be subjected to carbon recovery, while the second stope is retorted.

Figure 7:
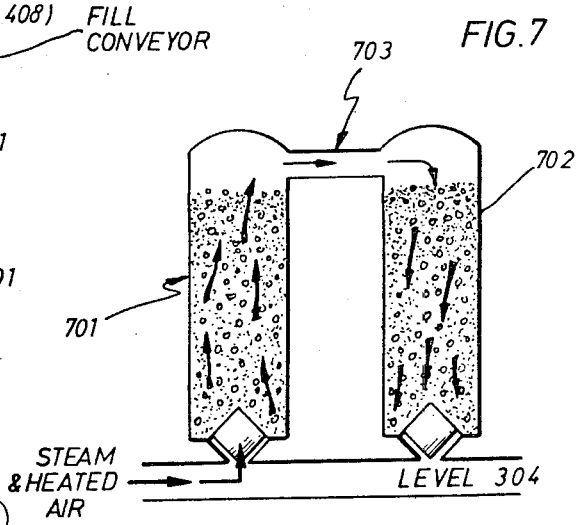
FIG. 7 is a side elevation view of two adjacent stopes in a panel, illustrating gas flow through the stopes.

With reference now to FIG. 7, there is illustrated the manner in which a first stope 701, which has been retorted, may be subjected to a carbon recovery process, while a second stope 702 is simultaneously retorted. Following the completion of the retorting of stope 701, steam and heated gas, including a controlled amount of air or other oxygen-containing gas, are injected into the base of stope 701. The residual carbon on the oil shale in stope 701 reacts with the mixture of steam and heated gas, which generates "producer fuel gas." The generation of producer fuel gas is an exothermic reaction which further heats the input gas to a retorting temperature, and the hot gas is channelled, via the upper level cross-cuts, to stope 702. Retorting of the oil shale particles in stope 702 is accomplished as previously described, and the products of the retorting are collected at level 304. While stope 701 is subjected to carbon recovery and stope 702 is subjected to retorting, a third stope (not shown in FIG. 7) is prepared for retorting in the manner described above.

Now referring to FIG. 8, three stopes, 801, 802, and 803, are illustrated. Stope 801 is a gas heating (sensible heat recovery) stope, the oil shale therein having been subjected to both retorting and carbon recovery. Stope 802 is a carbon recovery stope, the oil shale therein having been subjected to retorting. Stope 803 is a retort stope, the oil shale therein having been prepared for retorting as described above.

As described below with respect to FIG. 9, both gaseous and liquid substances, including water, are obtained as a result of retorting a stope. The gas phase product is cooled to recover condensable hydrocarbons, and a portion of the noncondensable fraction is recycled to the top of stope 801. The recycled gas is passed downwardly through the oil shale in stope 801, and is heated by the hot particles of retorted (spent) oil shale. The heated gas emerges from the base of stope 801 and is mixed with steam and a limited amount of air or other oxygen-containing gas.

The mixture of steam, heated gas, and air is then channelled to the base of stope 802. The mixture reacts with the residual carbon, thereby generating producer fuel gas, which is in turn injected into the top of stope 803 to retort the oil shale therein. The hydrocarbon products of the retorting of stope 803 are recovered at its base and directed to a suitable sump/separator 804. At least a portion of the noncondensable gas from the sump/separator 804 is channelled back to the top of stope 801, and the balance is transported to the surface for use. The liquid phase hydrocarbons are recovered as shale oil product, and the water is reused in generating steam or as process water in the mineral recovery process referred to below.

While the process shown in FIG. 8 is in progress, a fourth stope (not shown) is prepared for retorting in the manner described above. When the retorting of stope 803 is complete, the process described with reference to FIG. 8 is repeated, with stope 802 being the heating stope, stope 803 being the carbon recovery stope, and the fourth stope being the retort stope.

With reference to FIG. 9, there is schematically illustrated one embodiment of the sump/separator 305 employed in the processing of oil shale ore in accordance with the present invention. As shown most clearly in FIG. 3, one sump/separator 305 is provided per mining panel.

The gas and liquid phrase products of retorting, including liquid hydrocarbons and water, flow from level 304 into the sump/separator 305. Recycle cooling spray is applied to the mixture entering sump/separator 305 to cool the gas stream and condense the condensable hydrocarbons in the gas. The liquid phase comprises oil (including condensed hydrocarbons) and water, and flows into a first compartment 901 where the oil is separated from the water by a conventional differential density technique. A barrier 902 separates compartment 901 from compartment 903, and the oil is allowed to flow over the barrier into compartment 903. The water level in compartment 901 is maintained below the top of barrier 902 by pump extraction via conduit 904. The oil in compartment 903 is pumped to the surface for marketing, and the water is recycled for use in generating steam or used in the mineral recovery processes.

After a stope has been subjected to retorting and carbon recovery, and the sensible heat has been recovered, the spent shale may be leached to recover the aluminum and soda values therein.

Referring now to FIG. 10, there is illustrated stope 950, which contains spent shale. Leaching is accomplished by injecting a caustic leach liquor onto the top of stope 951 through one set of the cross-cuts on level 301 (FIG. 3). The leach liquor percolates downwardly through stope 951, dissolving soda ash and alumina. Leach liquor containing the dissolved soda and alumina ash is recovered at the base of stope 951 and may be pumped to the surface for crystallization and recovery of soda and alumina.

It will be appreciated that the make-up water for the caustic leach liquor may be passed through the immediately preceding stope to enhance the recovery of mineral values therefrom. Alternatively, the liquid emerging from the base of stope 951 may be percolated through one or more additional stopes 952, 953, prior to pumping it to the surface. This technique may be utilized to obtain a leach liquor richer in soda and alumina values. The recovery of alumina and soda ash from the concentrated leach liquor is exemplified by U.S. Pat. No. 3,821,353 referred to above, which is incorporated herein by reference.

What is claimed is:

1. A method of in situ processing of oil shale ore comprising the steps of:

(a) establishing first, second, and third underground stopes, each stope being established by removing a portion of the oil shale ore from the stope, rubblizing the remaining ore in the stope, extracting the rubblized ore from the stope, crushing the ore to obtain a first fraction comprising substantially nahcolite particles and a second fraction comprising substantially oil shale particles, separating the substantially nahcolite particles from the substantially oil shale particles, and restoring at least a portion of the substantially oil shale particles to the stope by back filling the stope with said oil shale particles as the extraction, crushing, and separation are carried out to maintain the stope substantially filled with particles, wherein the first stope is a heating stope and having been subjected to retorting and carbon recovery, the second stope is a carbon recovery stope and having been subjected to retorting, and the third stope is a retort stope;

(b) injecting gas into the first stope and heating the gas by passing it through the first stope to recover sensible heat from the spent shale therein;

(c) transferring the heated gas from the first stope to the second stope and using the heated gas together with steam and a limited amount of air to obtain producer fuel gas by reaction with the carbon on the spent shale in the second stope;

(d) transferring the producer fuel gas to the third stope and using the producer fuel gas to retort the contents of the third stope to produce gaseous and liquid hydrocarbons and water;

(e) collecting the liquid and condensable hydrocarbon products produced by the retorting of the third stope; and (f) transferring at least a portion of the noncondensable gaseous product of the retorting of the third stope to the first stope for heating to recover sensible heat from the spent shale in the first stope.

2. The method of claim 1, wherein the gas injected into the top of the first stope is passed downward through a bed of hot spent shale particles in the first stope to obtain heated gas at the base of the first stope.

3. The method of claim 1, further comprising the step of mixing the heated gas from the first stope with steam and oxygen as the heated gas is transferred to the second stope.

4. The method of claim 3, wherein the mixture of steam, heated gas, and oxygen is directed to the base of the second stope and is passed upwardly through the second stope.

5. The method of claim 1, further comprising the step of forming an underground sump for the collection of the products of retorting.

6. The method of claim 5, further including the steps of:

(a) separating the products of retorting the third stope into liquid and gas phases; and (b) separating the liquid phase into water and shale oil components.

7. The method of claim 6, wherein the separation of the liquid phase product of retorting into water and shale oil components is effected using a differential density technique.

8. The method of claim 1, further comprising the steps of establishing a fourth underground stope, and when the third stope is fully retorted, repeating the process of claim 1 with the second, third, and fourth stopes being the heating, carbon recovery, and retort stopes, respectively.

9. The method of claim 8, further comprising the step of leaching the spent oil shale in the first stope to obtain soda ash and alumina.

10. The method of claim 9, wherein the step of leaching includes the injection of a caustic leach liquor into the top of the first stope, percolating the leach liquor through the first stope to dissolve the soda ash and alumina, and recovering the leach liquor containing dissolved soda ash and alumina at the base of the first stope.

11. The method of claim 10, wherein the caustic leach liquor is percolated through a plurality of stopes to enrich the soda and alumina content of the liquor prior to recovery of soda ash and alumina from the liquor.

* * * * *